US005926859A

United States Patent [19]

Kimura

[11] Patent Number: 5,926,859

[45] Date of Patent: Jul. 27, 1999

[54] TOILET SYSTEM

[75] Inventor: Motoyasu Kimura, Tokyo, Japan

[73] Assignee: Kimura Industry Co., Ltd., Tokyo, Japan

[21] Appl. No.: 08/876,219

[22] Filed: Jun. 16, 1997

Related U.S. Application Data

[63] Continuation of application No. 08/492,909, Jun. 20, 1995, abandoned.

[30] Foreign Application Priority Data

Jun. 27, 1994 [JP] Japan ..... 6-145114

[51] Int. Cl.[6] ..... E03D 11/00

[52] U.S. Cl. ..... 4/254

[58] Field of Search ..... 4/254, 560.1, 604, 4/663

[56] References Cited

U.S. PATENT DOCUMENTS 2,396,992 3/1946 Evans ..... 4/663

FOREIGN PATENT DOCUMENTS

| | | |
|---|---|---|
| 2697563 | 5/1994 | France . |
| 3224377 | 1/1984 | Germany . |
| 5106382 | 4/1993 | Japan . |
| 88/01843 | 3/1988 | WIPO . |

OTHER PUBLICATIONS

European Patent Office Search Report for Application No. EP 95 304474.

*Primary Examiner*—Robert M. Fetsuga
*Attorney, Agent, or Firm*—Greer, Burns & Crain, Ltd.

[57] ABSTRACT

A toilet system comprises a door for opening and closing an entrance of a washroom and support members provided in one surface of the door for supporting the user. The door rotates with the support members about the longitudinal axis of the door. The support members include a seat and a hand rail so that the user can readily move onto a toilet in the washroom from the outside thereof.

3 Claims, 11 Drawing Sheets

TOILET SYSTEM

This application is a continuation of application Ser. No. 08/492,909 filed on Jun. 20, 1995, abandoned.

BACKGROUND OF THE INVENTION

1. Field of the Invention

The present invention relates to a toilet system for physically handicapped persons.

2. Description of the Prior Art

Conventionally, a toilet system which is well known has a structure in which a toilet is installed in a lavatory and a flat plate-like door is attached to the entrance of this lavatory by means of hinges.

However, a user who is physically handicapped in his/her lower limbs, particularly a person who uses a wheelchair, cannot enter the lavatory together with the wheelchair, since an ordinary lavatory is too narrow. Therefore, people using wheelchairs have used washrooms specially designed for them which have wide entrances and a large internal space.

Even in such a large washroom, it has been very difficult for users who are physically handicapped to move to the toilet from their wheelchairs. Therefore, it cannot truly be said that such a washroom is a toilet system which enables a physically handicapped person to feel comfortable while using it.

Several kinds of methods by which the user of a wheelchair moves onto the toilet will now be described hereinbelow.

According to a first method, the user seated on the wheelchair approaches the toilet from the front and moves onto the toilet (toilet seat) while sliding his/her body forward.

According to a second method, the user of a wheelchair approaches the toilet from the front and moves onto the toilet while turning his/her body 180°.

According to a third method, the user of a wheelchair approaches the toilet from the rear and moves onto the toilet while sliding his/her body rearward after removing the seat back of the wheelchair.

Where approaching the toilet according to the first method, since the user of the wheelchair faces the rear of the toilet, he/she is seated in an uncomfortable and unstable manner. Additionally, the user of the wheelchair must disadvantageously take off his/her underclothes completely to use the toilet.

In the case of the approach according to the second method, the user of the wheelchair has to turn his/her body, this being difficult for a person whose upper limbs are not strong and whose balance is not above average.

On the other hand, the third method is preferable for a person whose upper limbs or spine are/is weak. However, since few people employ a wheelchair whose seat back can be removed, most people cannot utilize such a method.

In addition to the above, a method by which a user of the wheelchair approaches the toilet obliquely can be considered. However, according to this method, since the user of the wheelchair must slide his/her body in a lateral direction or turn his/her body, it is again difficult for a person whose upper limbs are weak to utilize this method.

SUMMARY OF THE INVENTION

It is an object of the present invention to adequately overcome these problems and provide a toilet system which can be easily and readily used by people having a physical handicap or elderly people who are weak in their lower limbs. Another object of the present invention is to provide a toilet system in which a user having a physical handicap or an elderly person can simply and smoothly move onto and sit on a toilet stably and safely. Still another object of the present invention is to provide a toilet system in which space can be effectively utilized.

The subject matter of the present invention resides in a toilet system comprising a door and support members provided on one side of the door, the door being rotated with the support members about its longitudinal axis.

The above-mentioned door and support members will be described in detail in the following.

The door serves to open and close the entrance of a washroom. A flat plate-like door may be used as a door plate. A door having a front surface formed in a convex shape and a back surface formed in a concave shape may be used. Preferably, the door may be provided with a front surface formed in a convex shape and a back surface formed in a concave shape. This door is rotated about its longitudinal axis.

The above-described support members are located on one side of the door to support the user. As support members, for example, a seat or a hand rail may be utilized. The above-described support members are rotated with the door about the longitudinal axis of the door.

In a case where the support member is a seat, this seat is preferably provided so as to be movable both towards and away from the door. Further, the above-mentioned seat is preferably provided so that the seat moves towards the toilet in the washroom when the seat is situated in the washroom. Additionally, the seat can be moved over the toilet in the washroom when the seat is located in the washroom.

Furthermore, the seat can be attachable to and detachable from one side of the door. Also, the seat is connected to the door side by a connecting part and can be rotated upward or downward from a horizontal position about the connecting part as a supporting point.

The above-mentioned door and the support members are each preferably rotatable or slidable by means of a driving device such as a motor. In this case, the driving device may be controlled by the user by means of a switch.

In addition to the door and the support members, an arm part may be provided as an additional component.

This arm part is fixed to the door. At least one of an upper end part and a lower end part of the door is fixed to the ceiling or floor at the longitudinal axis of the door. Thus, the arm part supports the door rotatably about the upper end part or the lower end part of the arm part. It is preferred to connect the arm part to the support members.

When a user uses this toilet system, he/she supports his/her body with the support members outside the washroom. Then the user rotates the door with the support members, so that the user can enter the washroom. The user entering the washroom moves onto the toilet from these support members.

After ablutions are finished, while the body of the user is supported again by means of the support members, the support members are rotated with the door so that the user can leave the washroom.

BRIEF DESCRIPTION OF THE DRAWINGS

Further features and advantages will be more readily apparent from the following detailed description of a toilet system, as illustrated by way of examples in the accompanying drawings, wherein.

DESCRIPTION OF THE PREFERRED EMBODIMENTS

Figure 1:
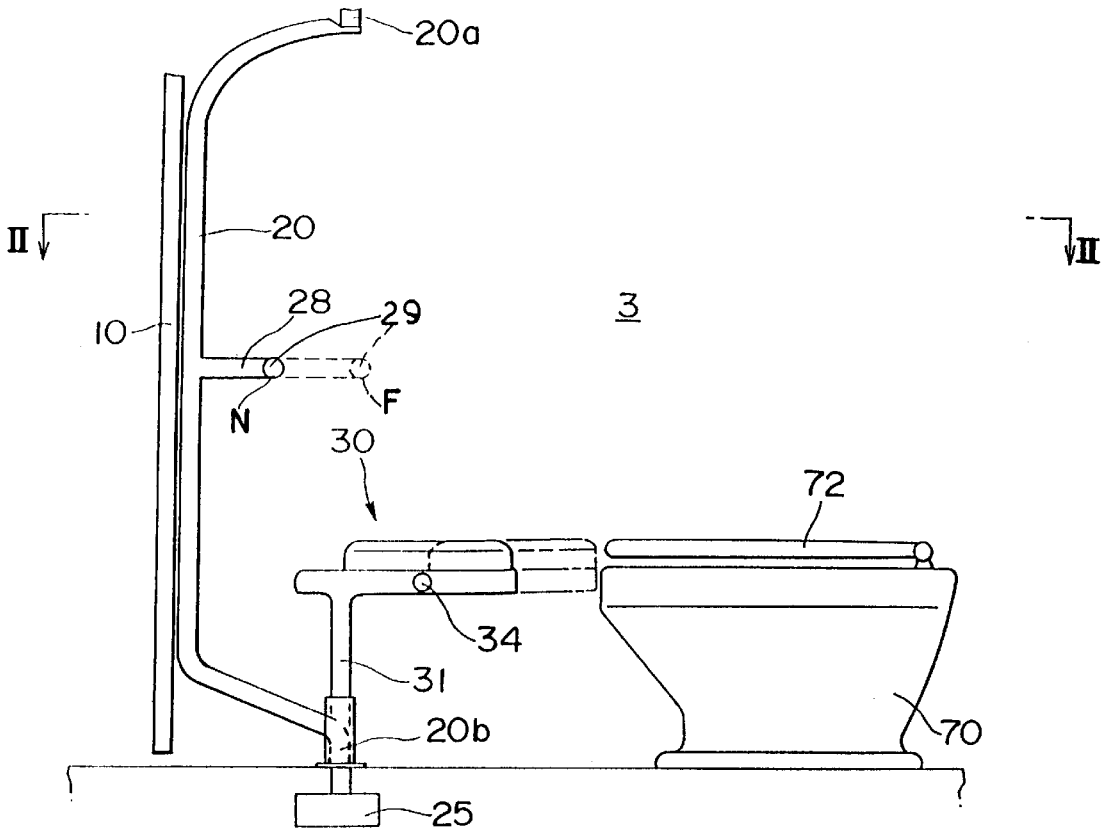
FIG. 1 is a side view of a first embodiment of a toilet system according to the present invention.
Figure 2:
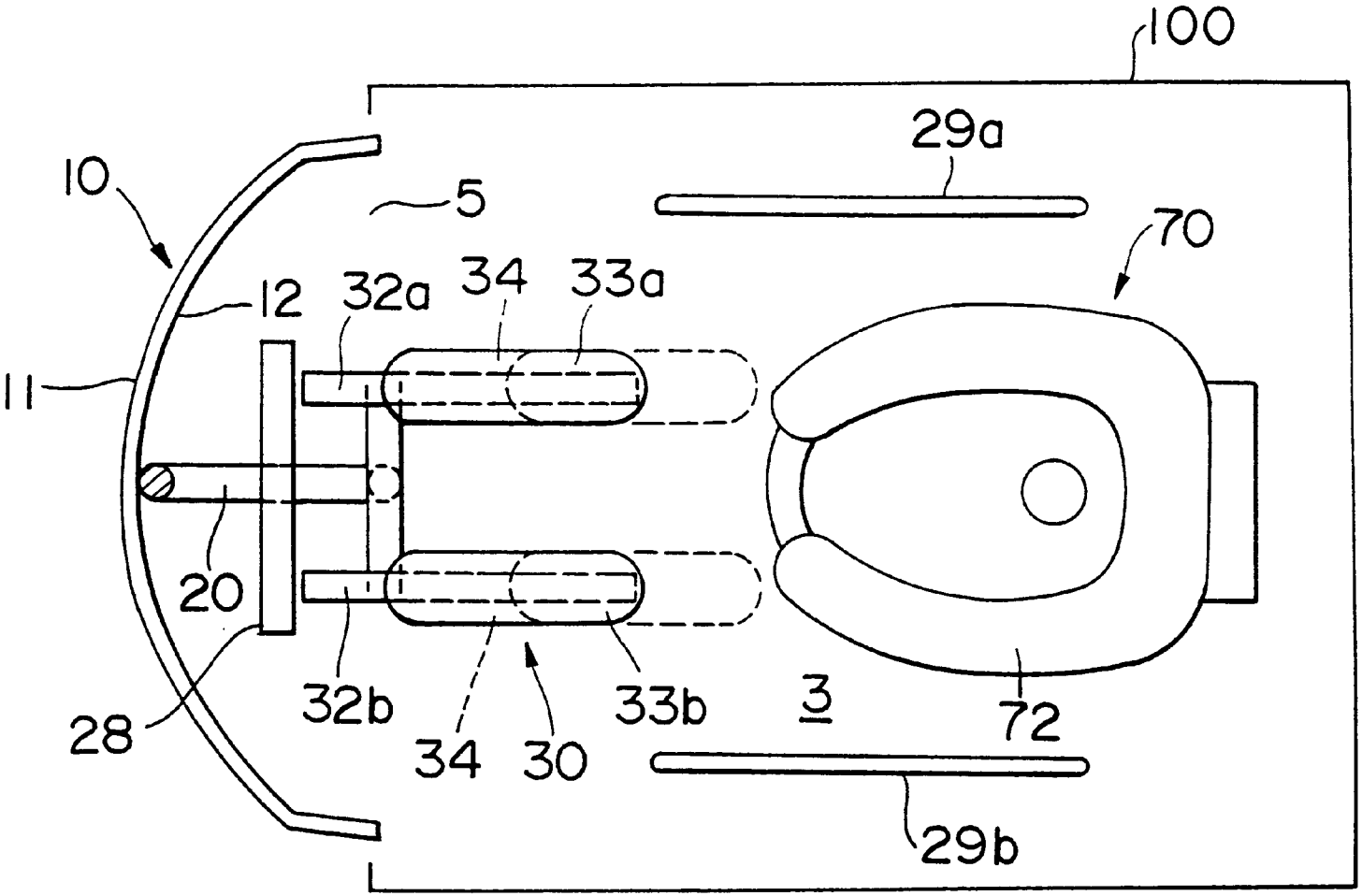
FIG. 2 is a partial cross-sectional plan view taken along the line A—A of FIG. 1.

Embodiments of the present invention will now be described in further detail hereinbelow while referring to the accompanying drawings.

EMBODIMENT 1

A first embodiment of the present invention will be described below with reference to FIGS. 1 to 6.

In the first embodiment, a washroom 3 having an entrance 5 in the front is formed by an outer wall 100. A toilet 70 is provided in the washroom 3. Hand rails 29*a* and 29*b* are provided at both sides of this washroom 3. A door for opening and closing the entrance 5 of the washroom 3 includes a door 10 having a front surface 11 formed in a convex shape and a rear surface 12 formed in a concave shape, and an arm part 20 for supporting this door 10.

The above-described arm part 20 is fixed to the rear surface 12 of the door 10 at an intermediate part of the arm part 20. The upper end part 20*a* of the arm part 20 is supported by the ceiling. The lower end part 20*b* of the arm part 20 is supported on the floor surface. The upper end part 20*a* and the lower end part 20*b* are located at the longitudinal axis of the door and spaced apart from the door at the back surface 12 (in the center of curvature) of the door 10.

At the back surface 12 of the door, a temporary seat 30 is provided as a first support member. The seat 30 has a support rod 31 extending upward from the lower end part 20*b* of the arm part 20, a first base 32*a* and a second base 32*b* branching away from the support rod 31 in two sections, and a first seat part 33*a* mounted on the first base 32*a* and second seat part 33*b* mounted on the second base 32*b*. A driving device 25 for rotating the lower end part 20*b* is provided below the lower end part 20*b*.

A hand rail 28 extends horizontally from the intermediate part of the arm part 20 as a second support member. This hand rail 28 protrudes from the door 10 and extends along and at a distance from the door.

Bearings are attached to the upper end part 20*a* and the lower end part 20*b* so that the door 10 can be smoothly rotated.

The first seat part 33*a* and the second seat part 33*b* of the seat 30 can slide forward and backward with extension and retraction of the first and second bases 32*a* and 32*b*. The first base 32*a* and the second base 32*b* each have lower members and upper members which slide along the lower members so that they can be extended and retracted. The first seat part 33*a* and the second seat part 33*b* are controlled by stoppers 34 provided at the sides of the first base 32*a* and the second base 32*b*.

Figure 6:
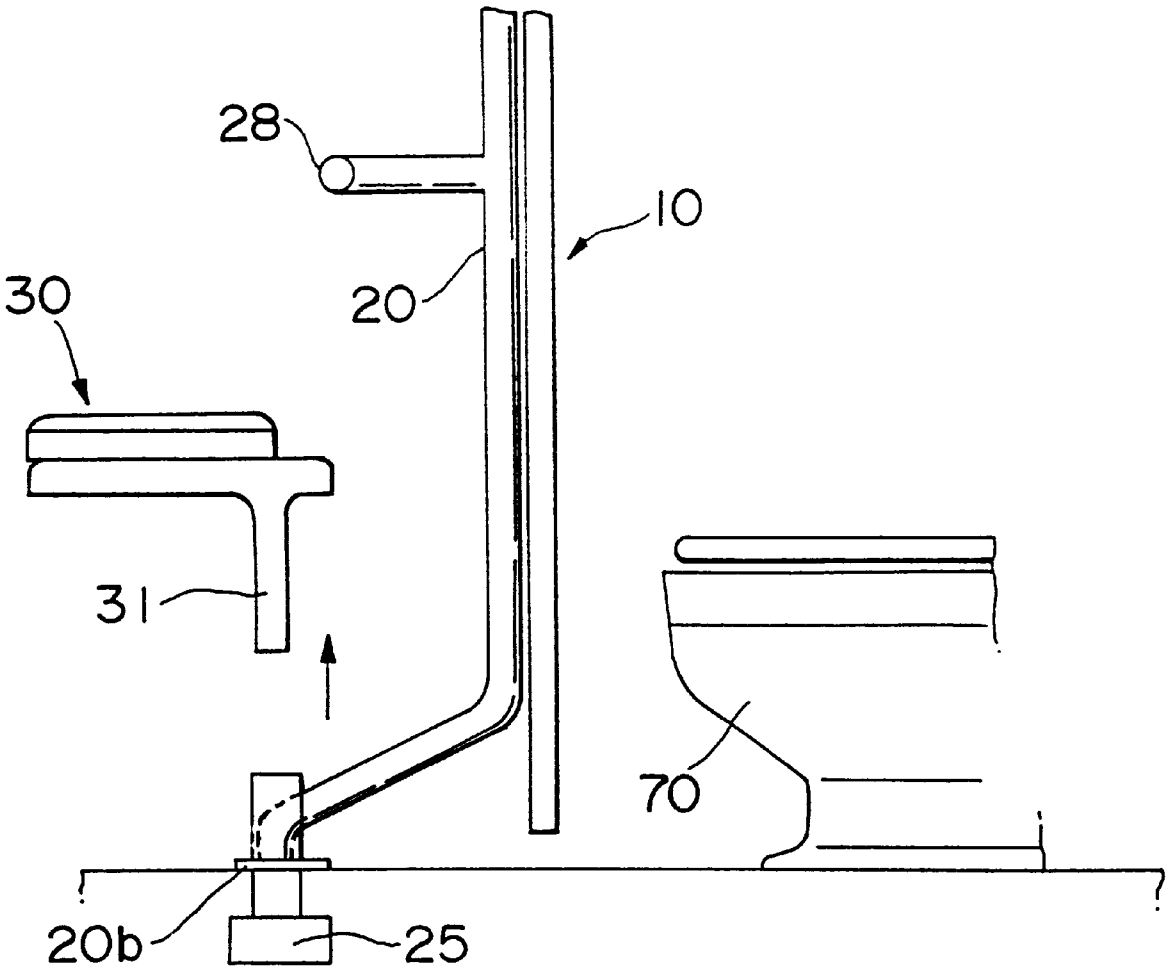
FIG. 6 is a view illustrating a state in which a seat to be occupied according to the first embodiment is detached from an arm part.
Figure 7:
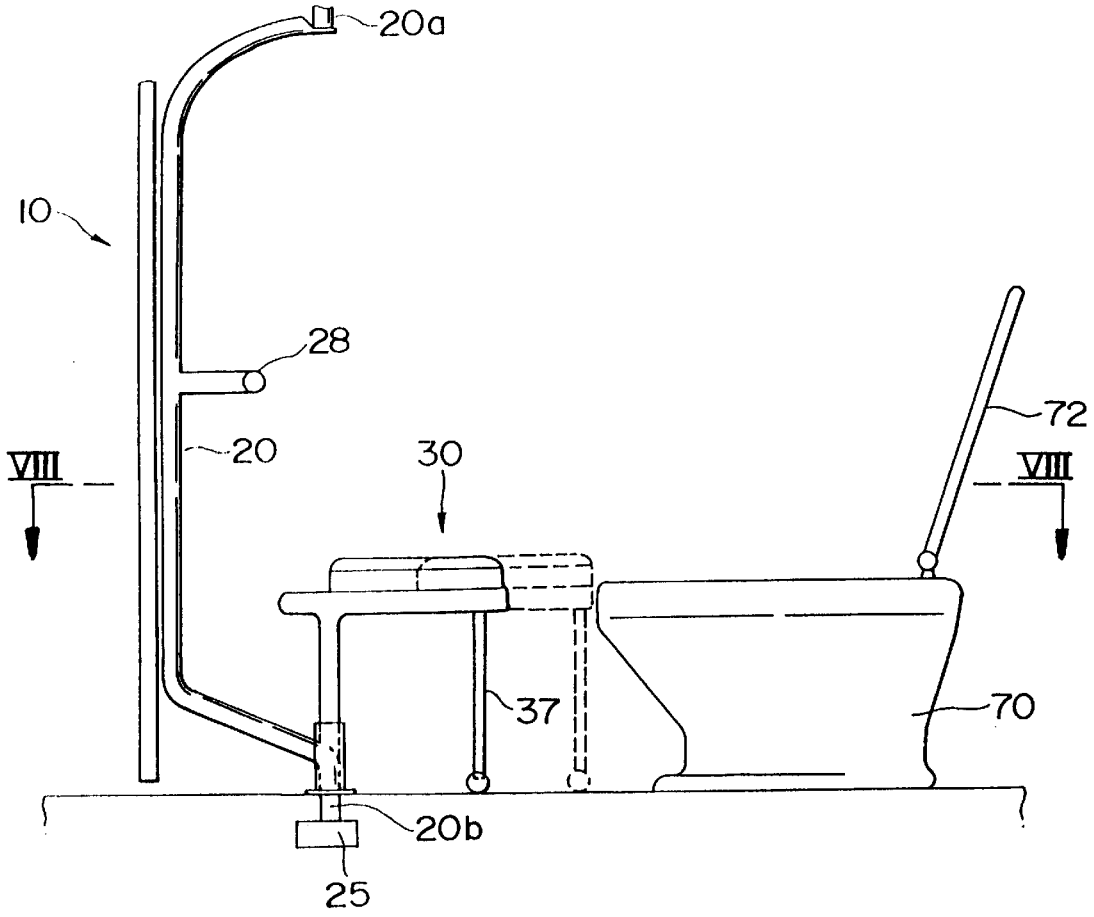
FIG. 7 is a cutaway side view of a second embodiment of a toilet system according to the present invention.

The lower end part of the seat 30 can be rotated about a shaft 38 as a support point. When the toilet is not used, the seat 30 can be housed in a compact state as illustrated by double broken lines in FIG. 3. The seat 30 can be detached from a part of the lower end part 20*b*, as can be seen in FIG. 6, and may be attached or removed when desired.

The operation of the first embodiment of the toilet system will now be described.

In this description, an example where a user of a wheelchair having a physical handicap in his/her lower limbs employs the toilet system of the present embodiment will be described.

Figure 3:
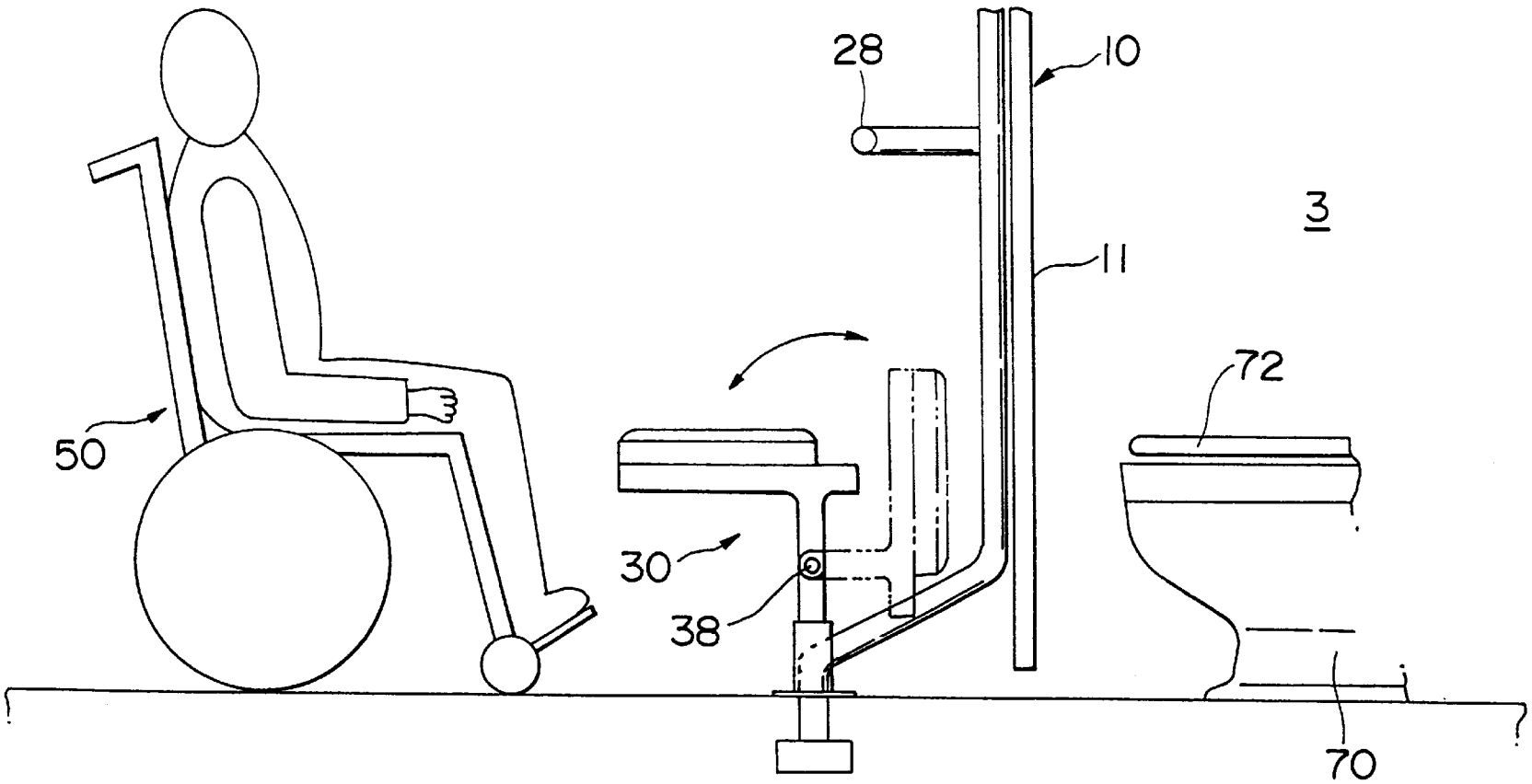
FIG. 3 is a side view showing a state in which the toilet in the first embodiment is not used.

When the washroom 3 is not used, the front surface 11 of the door 10 faces the inside of the washroom 3, as illustrated in FIG. 3.

The user of a wheelchair 50 seated thereon approaches the door 10 and swings the seat 30, which is rotated about the shaft 38 as a supporting point and housed in the door 10 side, into a horizontal position. Then, while the first seat part 33*a* and the second seat part 33*b* of the seat 30 slide forward (towards the front), the seat 30 is fixed in position by the stoppers 34. Thereafter, the user moves onto the seat 30 from the wheelchair 50 while sliding his/her body forward. At this time, the user moves onto the seat while holding the hand rail 28 which protrudes and can be horizontally moved, as illustrated in FIG. 1, between a position where an end 29 of the hand rail 28 is proximate or near the door 10, as illustrated at position N, and a position where end 29 is distal from the door 10, as illustrated in broken lines at position F.

Figure 4:
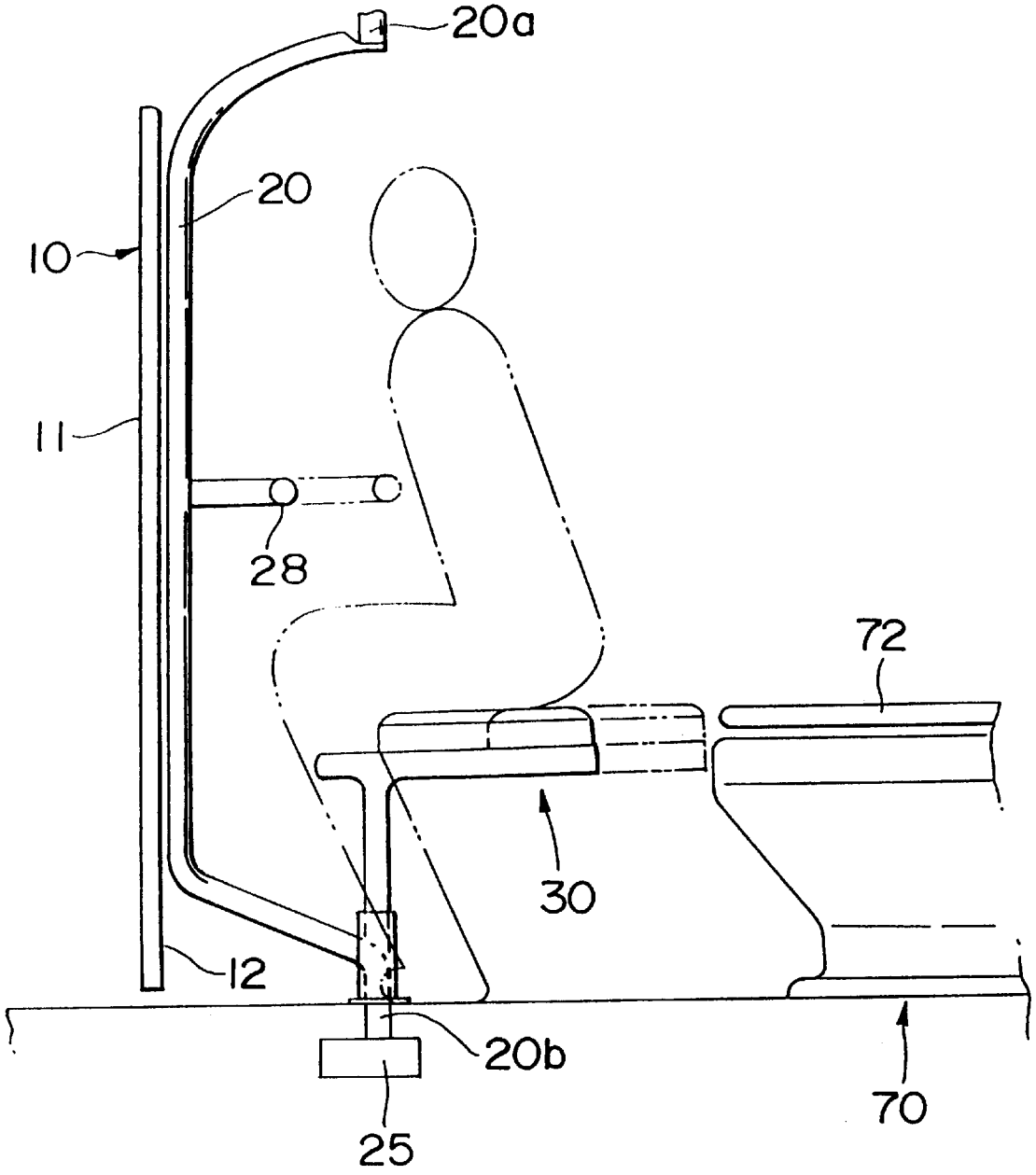
FIG. 4 is a side view showing a state in which the toilet in the first embodiment is being used.
Figure 5:
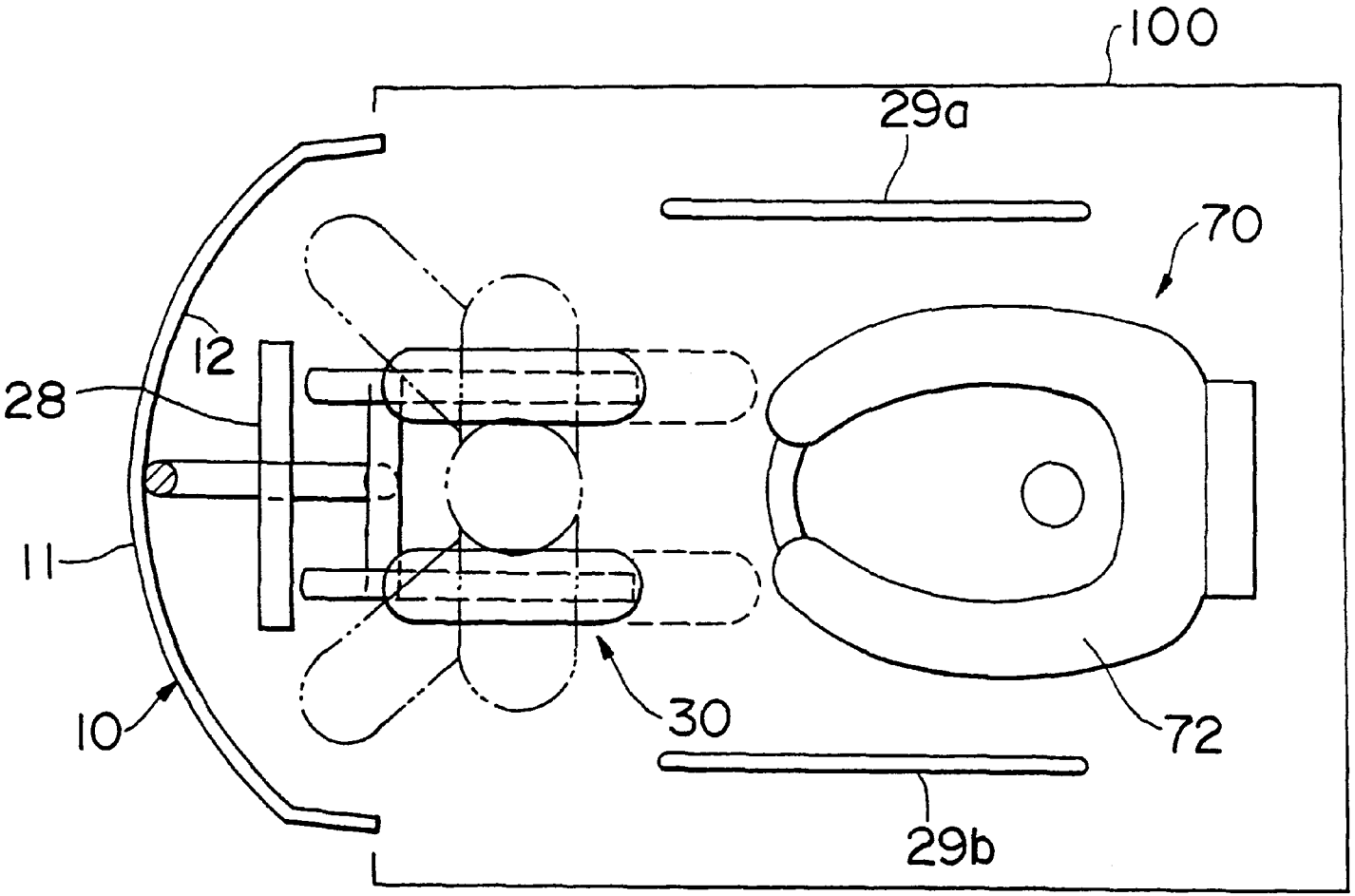
FIG. 5 is a partial cross-sectional plan view showing a state in which the toilet in the first embodiment is being used.

After the user moves onto the seat 30, the first seat part 33*a*, the second seat part 33*b* and the hand rail 28 slide toward the door 10. Then, a switch (not shown) is used to operate a driving device 25. The door 10 is rotated 180° about the lower end part 20*b* by the driving device 25. At this time, the seat 30 is also rotated 180° with the door 10, so that the user can enter the washroom 3 as shown in FIG. 4. Upon rotation of the door 10 and the seat 30, the wheelchair 50 does not come into contact with the front surface 11 of the door 10 since it has been left in the vicinity of the position where the first seat part 33*a* and the second seat part 33*b* were pulled away from the door 10.

When the rotating operation of the door 10 is completed, the first seat part 33*a* and the second seat part 33*b* slide towards the toilet 70 by means of another switch operation. When the seat parts 33*a* and 33*b* reach the toilet 70, they are fixed in place. Then, while the user slides his/ her body rearward, he/she moves onto the toilet seat 72 of the toilet 70. After the user uses the toilet, he/she carries out the above-mentioned operation in reverse and returns to the wheelchair 50 which is stopped outside the washroom 3. In this case, alternatively, the door may be manually rotated.

Further, a foot board or a pipe or the like for the user to rest his/her legs on when seated on the seat 30 may be formed in the lower part of the arm part 20 or on the support rod 31 of the seat 30.

EMBODIMENT 2

A second embodiment of the toilet system according to the present invention will be described while referring mainly to FIGS. 7 to 10. According to the present embodiment, the seat which rotates with the door can be moved over the toilet. Explanation of components and operations identical to those described in the first embodiment will be omitted for the purpose of simplicity.

Figure 8:
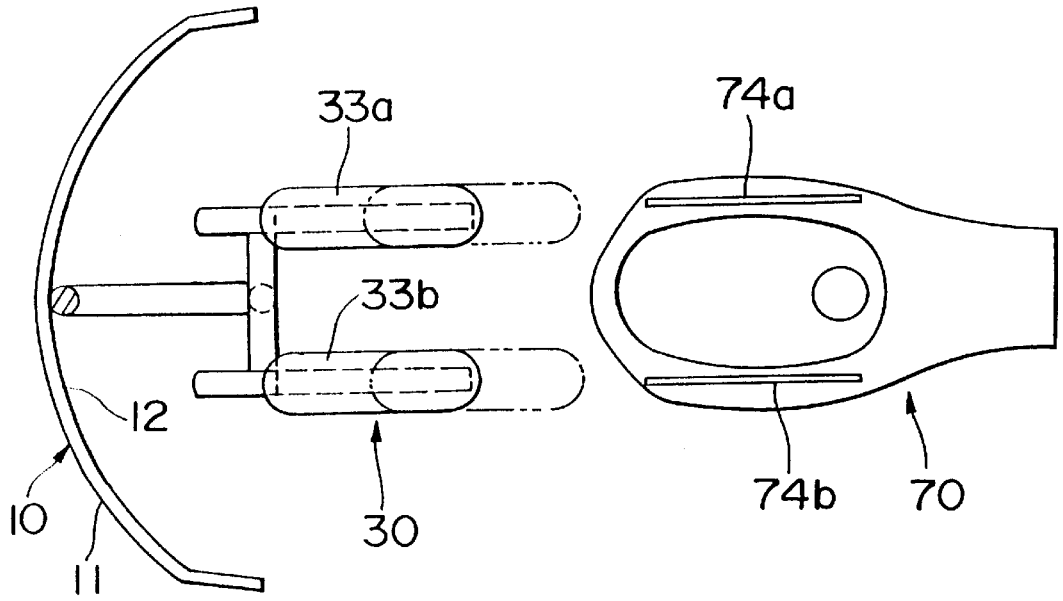
FIG. 8 is a partial cross-sectional plan view taken along the line B—B in FIG. 7.
Figure 9:
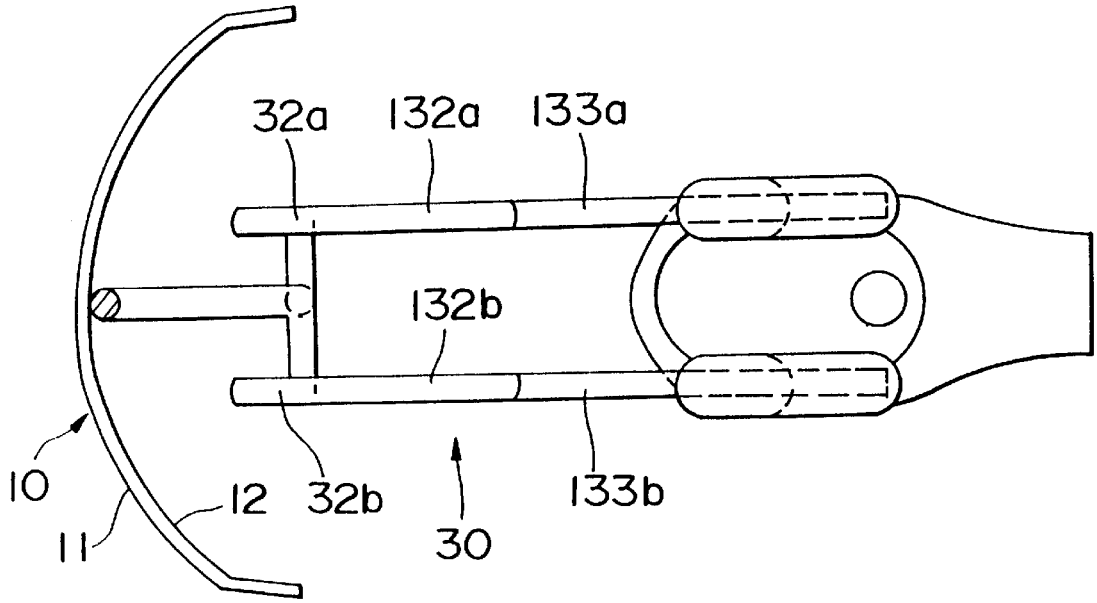
FIG. 9 is a partial cross-sectional plan view taken along the line B—B in FIG. 7 showing a state where the toilet is being used.
Figure 10:
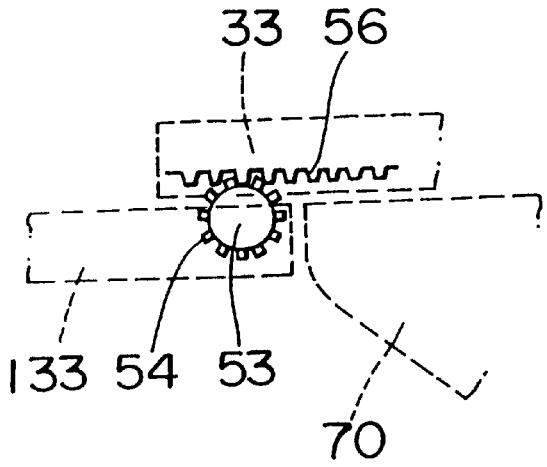
FIG. 10 is a side view of the second embodiment showing a sliding state of a seat part.

As illustrated in FIG. 8, on the upper part of the toilet 70, slits 74*a* and 74*b* are formed as rails for sliding the first seat part 33*a* and the second seat part 33*b*. The first base 32*a* and the second base 32*b* on which the seat parts 33*a* and 33*b* are mounted are provided with lower members 132*a* and 132*b* and upper members 133*a* and 133*b* which slide along the lower members. As shown in FIG. 9, the upper members 133*a* and 133*b* extend to the vicinity of the front end parts of the toilet 70. When the toilet seat 72 attached to the toilet 70 is raised, a driving gear 53 provided at an end part of each of the upper members 133 rotates as illustrated in FIG. 10. Then, teeth 56 formed on the lower surfaces of the first seat part 33*a* and the second seat part 33*b* mesh with the teeth 54 of the driving gears 53 so that the seat parts 33 are moved forward and backward. When the rear ends of the first seat part 33*a* and the second seat part 33*b* reach the driving gears 53, the rotation of the driving gears 53 is stopped and both seat parts are located over the toilet 70 to serve as a toilet seat.

Further, auxiliary wheels 37 are provided on the lower parts of the first base 32*a* and the second base 32*b* so that the user can be more stably supported.

As described above, according to with the second embodiment of the toilet system of the invention, since the seat is moved directly over the toilet, the user can more easily move onto the toilet.

EMBODIMENT 3

A third embodiment of a toilet system according to the present invention will now be described referring mainly to FIGS. 11 to 13. As in the second embodiment, explanation of components and operations identical to those in the previous embodiments will be omitted for simplicity.

Figure 11:
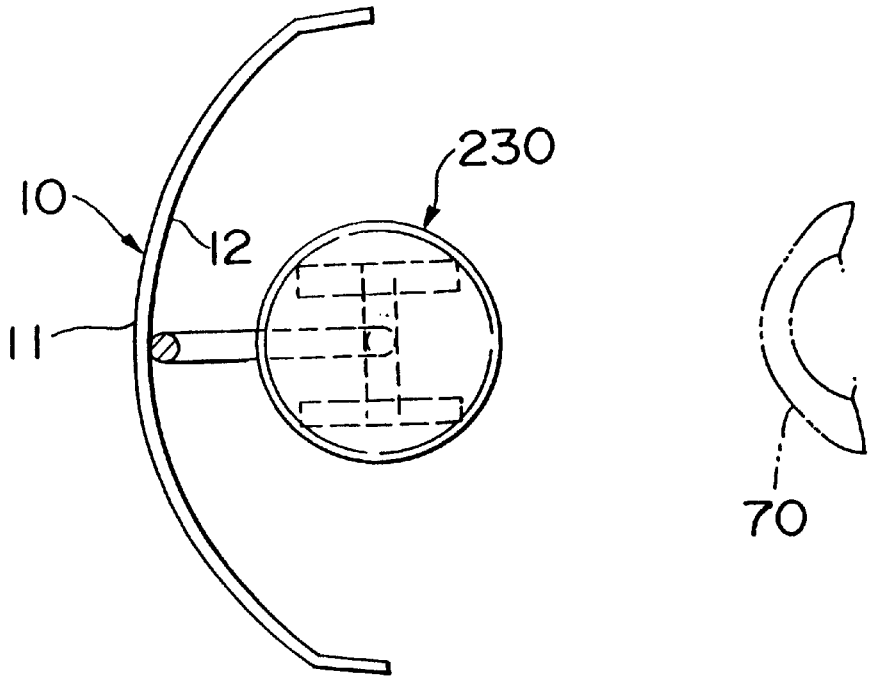
FIG. 11 is a partial cross-sectional plan view of a third embodiment of a toilet system according to the present invention.

A seat 230 employed in the present embodiment is formed as a round chair having a circular upper part, as clearly shown in FIG. 11.

Figure 12:
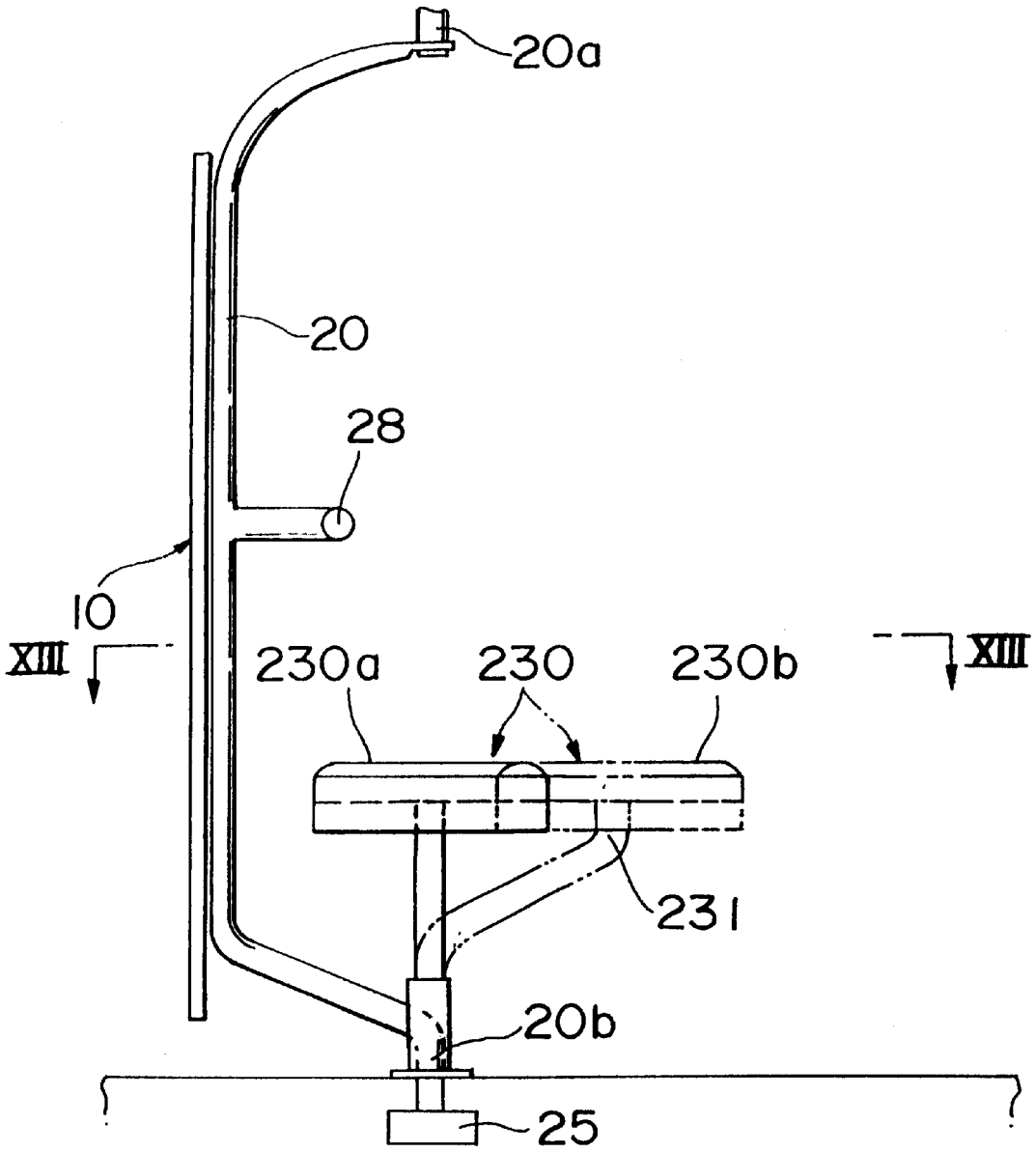
FIG. 12 is a partial cutaway side view of the third embodiment.
Figure 13:
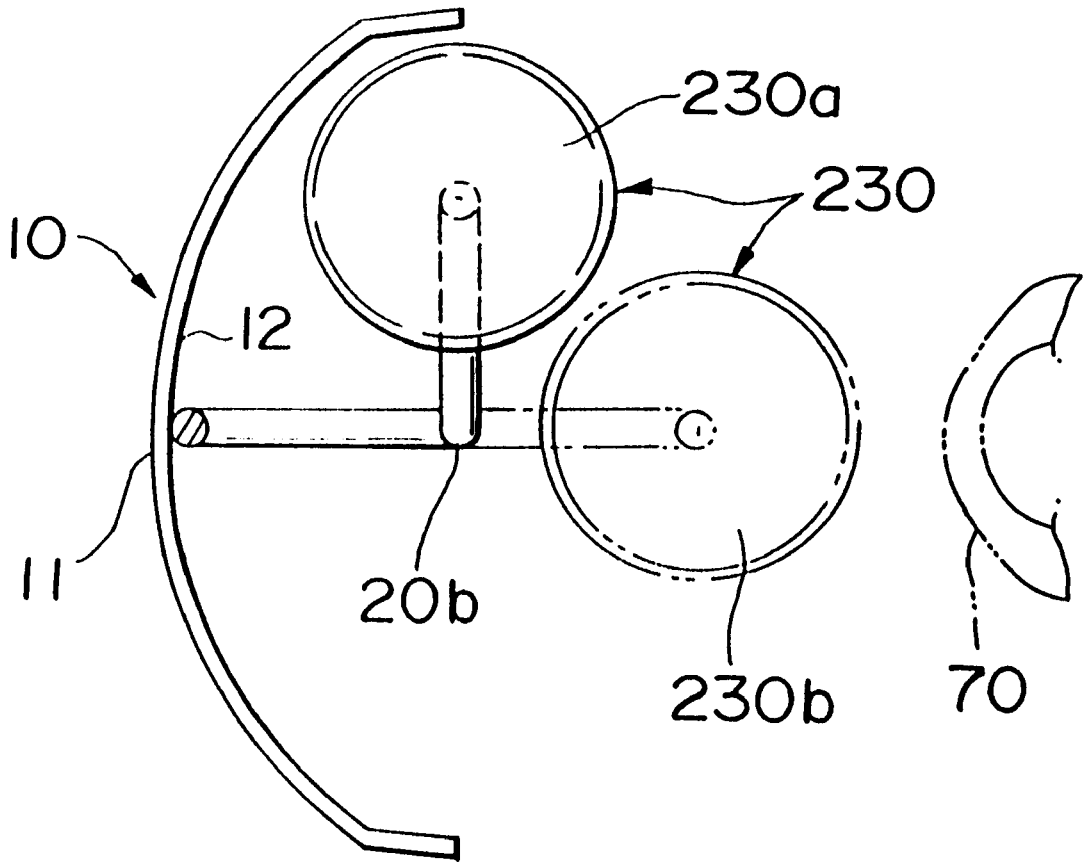
FIG. 13 is a partial cross-sectional plan view of the third embodiment taken along a line C—C of FIG. 12.

As illustrated in FIGS. 12 and 13, the seat 230 may be moved from a position indicated by 230*a* to a position indicated by 230*b* around the lower end part 20*b*. Further, the seat 230 can be rotated about a center part 231.

Although in the first to third embodiments the entrance 5 to the washroom 3 is provided at the front of the washroom 3 (front side of the toilet 70), it is to be understood that the entrance can alternatively be provided at the side of the washroom 3 so that the seat approaches the toilet 70 sideways or obliquely in the forward direction of the toilet 70.

As described above, according to the present invention, a toilet system which can be very easily employed by physically handicapped persons is provided. Specifically, according to the present invention, physically handicapped people can smoothly and readily move onto the toilet and carry out their ablutions stably and safely.

Additionally, when the door of the present invention is formed in a curved shape, the space inside the washroom increases when the washroom is in use, and when the washroom is not in use, the space in the washroom decreases and the space outside the washroom can be increased. Therefore, space can be more effectively utilized with this toilet system. For example, if the toilet system according to the present invention is employed in an existing narrow washroom, support members can be installed without difficulty since space is increased due to the curved door.

What is claimed is:

1. Apparatus for use in a toilet system which has a toilet in a washroom area, the apparatus comprising:

a door for opening or closing an entrance of the washroom area, the toilet being spaced from said door; and at least one support member provided adjacent to one side of said door to support a user, wherein said door rotates with said support member about a longitudinal axis, said support member being movable between a position where it is in the vicinity of the door and a position where it is separated from the door;

wherein an arm part is fixed to said door and has an upper end part and a lower end part, both parts of which are located at the longitudinal axis, said door being supported so as to be rotatable about both said upper end part and said lower end part of said arm part to thereby open or close said entrance of the washroom, and when the washroom is in use, the door is rotated so that the front surface of the door protrudes outside the washroom to thereby increase the space in the washroom, and when the washroom is not in use, said door is rotated so that the front surface of the door faces the inside of the washroom to thereby decrease the space in the washroom;

wherein said at least one support member includes a seat, which is movable towards the toilet in the washroom when said seat is located inside the washroom, and further wherein said seat can be moved over the toilet in the washroom when said seat is located inside the washroom.

2. The apparatus of claim 1, wherein said seat is attachable to and detachable from one side of said door.

3. The apparatus of claim 2, wherein said seat is connected to said door side by a connecting part and rotates upward and downward from a horizontal position about the connecting part, with the connecting part as a support point.

* * * * *